US005941289A

United States Patent [19]

Fuchs

[11] Patent Number: 5,941,289

[45] Date of Patent: Aug. 24, 1999

[54] APPARATUS FOR MAKING AND INSERTING HELICAL WIRE BINDERS

[75] Inventor: Ferdinand Fuchs, Nürtingen, Germany

[73] Assignee: Womako Maschinenkonstruktionen GmbH, Germany

[21] Appl. No.: 08/902,899

[22] Filed: Jul. 30, 1997

[30] Foreign Application Priority Data

Aug. 16, 1996 [DE] Germany ..... 196 32 894

[51] Int. Cl.[6] ..... B21F 21/00; B42B 5/12

[52] U.S. Cl. ..... 140/92.3; 72/145; 412/39; 412/40; 402/57

[58] Field of Search ..... 42/33, 34, 38, 42/39, 16, 20, 21, 25, 30, 40; 281/27.1, 27.2; 402/57; 140/71 R, 71 C, 92.3, 92.93, 92.94, 92.2, 92.4, 100, 105; 72/145, 141

[56] References Cited

U.S. PATENT DOCUMENTS

| | | | |
|---|---|---|---|
| 2,808,079 | 10/1957 | Tauber | 140/92.3 |
| 2,961,012 | 11/1960 | Freundlich | 140/92.3 |
| 3,101,750 | 8/1963 | Pfäffe . | |
| 3,134,406 | 5/1964 | Freundlich | 140/92.3 |
| 3,520,334 | 7/1970 | Mueller | 140/92.94 |
| 3,568,728 | 3/1971 | Mueller | 140/92.94 |
| 3,688,809 | 9/1972 | Negro . | |
| 3,818,954 | 6/1974 | Pfaffle | 140/92.3 |
| 3,972,109 | 8/1976 | Sickinger | 140/92.94 |
| 4,249,278 | 2/1981 | Pfäffe . | |
| 4,351,371 | 9/1982 | Mann et al. | 140/92.3 |
| 4,378,822 | 4/1983 | Morris | 140/92.3 |
| 5,695,308 | 12/1997 | Hastings et al. | 412/39 |

FOREIGN PATENT DOCUMENTS

| | | |
|---|---|---|
| 1 041 919 | 10/1958 | Germany . |
| 1 944 223 | 4/1971 | Germany . |
| 2 044 676 | 3/1980 | United Kingdom . |

OTHER PUBLICATIONS

European Search Report Jan. 16, 1998.
German Serach Report Jan. 9, 1997.

*Primary Examiner*—Frances Han
*Attorney, Agent, or Firm*—Venable; George H. Spencer; Robert Kinberg

[57] ABSTRACT

An apparatus for converting a length of metallic or other wire into a series of successive helical wire binders and for threading successive binders into rows of holes in the spines of successive stacks of sheets at a binding station includes an elongated guide defining an at least substantially continuous path for the wire from a wire inserting station to the binding station. The guide includes a rotary convoluting tool at the inserting station and a stationary cylindrical worm coaxial with the tool and extending from the latter to the binding station. Successive foremost binders are threaded into the rows of holes in successive stacks at the binding station and are severed from the respective following binders by a set of knives when the threading steps are completed.

13 Claims, 2 Drawing Sheets

14
17
6
11
6
9
18
16
21
12
19
8
7
6
4

APPARATUS FOR MAKING AND INSERTING HELICAL WIRE BINDERS

BACKGROUND OF THE INVENTION

The invention relates to improvements in apparatus for making helical binders and for inserting such binders into rows of holes in selected portions of accumulations of overlapping sheets, such as into rows of perforations in the spines of stacked paper sheets which are to be converted into calendars, steno pads or other types of stationery products.

More particularly, the invention relates to improvements in apparatus for converting a continuous length of metallic or other wire into binders in the form of tubular coils which can serve to connect the sheets of a stack or a similar accumulation of overlapping sheets in such a way that the sheets can be turned through up to 360° about the axis of a properly inserted binder.

As a rule, a binder which constitutes a tubular coil with a selected number of helical convolutions is being made of a metallic wire, of metallic wire in a plastic jacket, or a plastic wire. For the sake of simplicity, and since the improved apparatus can be utilized for the making of binders in the form of tubular coils from any suitable deformable wire-like material, the starting product will be referred to as wire with the understanding, however, that such starting product can constitute a strand of coated or uncoated material consisting of or containing a suitable metallic, plastic or other ingredient which renders the ultimate product suitable for use as a reliable and preferably eye-pleasing binder of overlapping sheets at the spine of a calendar, a pad or any other product containing or consisting of overlapping panels or sheets made of paper, plastic, metallic foil or the like.

OBJECTS OF THE INVENTION

An object of the invention is to provide an apparatus which is designed to facilitate and simplify the threading of successive binders in the form of tubular coils into rows of holes (e.g., perforations) in selected portions (e.g., in the so-called spines) of accumulations (such as stacks) of overlapping sheets or panels of paper, plastic and/or other suitable material or materials.

Another object of the invention is to provide an apparatus which ensures that the configuration of each of a short or long series of successively produced binders is best suited for convenient and predictable threading into selected apertured portions of accumulations of overlapping sheets of paper or the like.

A further object of the invention is to provide the apparatus with novel and improved means for reliably guiding the wire all the way from the source to a binding station where the binders are threaded into rows of holes provided in successively supplied accumulations of overlapping sheets and/or panels and/or foils.

An additional object of the invention is to provide the apparatus with novel and improved means for guiding, deforming and otherwise treating or manipulating a length of wire between a suitable source of wire and a binding or inserting station.

Still another object of the invention is to provide a novel and improved method of manipulating a length of wire between a suitable source and a binding station where successive binders constituting tubular coils of predictably deformed wire are threaded into selected perforated portions of stacks of paper sheets or the like.

A further object of the invention is to provide an apparatus which is designed to ensure disturbance-free making and insertion of tubular wire coils into apertured portions of stacked sheets of paper, plastic, foil or the like.

Another object of the invention is to provide stationery and/or other products wherein sheets and/or panels are coupled to each other by binders made in and inserted by the above outlined apparatus.

SUMMARY OF THE INVENTION

The apparatus of the present invention serves to convert a length of wire (e.g., a length supplied by a spool of convoluted wire) into a series of successive helical binders and for inserting successive binders of the series into rows of holes in selected portions of discrete accumulations of overlapping sheets (as used hereinafter, the term sheets is intended to encompass sheets, panels, foils or like configurations made of paper, plastic and/or metallic material or materials) at a binding or threading station. The improved apparatus comprises guide means defining an at least substantially continuous path (e.g., an at least substantially straight horizontal or otherwise inclined path) for the wire from a wire inserting or introducing station and all the way to the binding station. The apparatus further comprises means for transforming the wire in the path into a series of successive binders.

The guide means can comprise a rotary wire convoluting tool and a stationary worm which is at least substantially coaxial with the tool. The latter can form part of the means for transforming the wire into a series of successive binders. As a rule, the tool is located between the inserting station and the worm, and the worm is disposed between the tool and the binding station.

The binders of the aforementioned series of successive binders can be said to include a succession of foremost binders and binders following the foremost binders. The apparatus preferably further comprises means for separating (such as severing) successive foremost binders from the respective following binders upon arrival of successive foremost binders at the binding station, i.e., upon completed threading of such foremost binders into the rows of holes in selected portions of accumulations of sheets then located at the binding station. The guide means (such as the aforementioned worm) includes a front end portion at the binding station, and such front end portion can be provided with a recess. The recess is desirable when the separating means comprises at least one knife which is located in the recess at least in the course of separation of a foremost binder from the respective following binder. The separating means can comprise a mobile (e.g., pivotable) knife and a stationary knife, and a portion of the stationary knife can be located in the recess of the front end portion of the guide means.

The apparatus can further comprise a rotary hold-down device for the wire in the aforementioned path. Such device is adjacent the rotary wire-convoluting tool of the guide means, and the apparatus can further comprise means for positioning the hold-down device relative to the tool in dependency upon the lead of the binders. For example, the hold-down device can comprise at least one roller having a peripheral surface provided with a helical wire-receiving groove. The positioning means for the hold-down device can comprise a resilient carrier, and such carrier can comprise one or more leaf springs secured to a housing of the improved apparatus.

The rotary wire convoluting tool of the guide means can include a substantially conical (particularly frustoconical) section which is adjacent the wire inserting station and diverges in a direction toward the binding station. Such tool can further comprise a substantially cylindrical section between the conical section and the binding station, and the maximum diameter of the conical section can match or approximate the diameter of the cylindrical section. The latter is coaxial with the aforementioned worm of the guide means.

The improved apparatus is preferably further provided with means for adjusting the guide means and/or the wire transforming means so that the apparatus can convert a length of wire into binders having different diameters and/or different pitches.

The advancement of the wire can be interrupted during separation of successive foremost binders from the respective following binders.

The novel features which are considered as characteristic of the invention are set forth in particular in the appended claims. The improved apparatus itself, however, both as to its construction and the mode of installing an operating the same, together with numerous additional important and advantageous features thereof, will be best understood upon perusal of the following detailed description of certain presently preferred specific embodiments with reference to the accompanying drawings.

DESCRIPTION OF PREFERRED EMBODIMENTS

Figure 1:
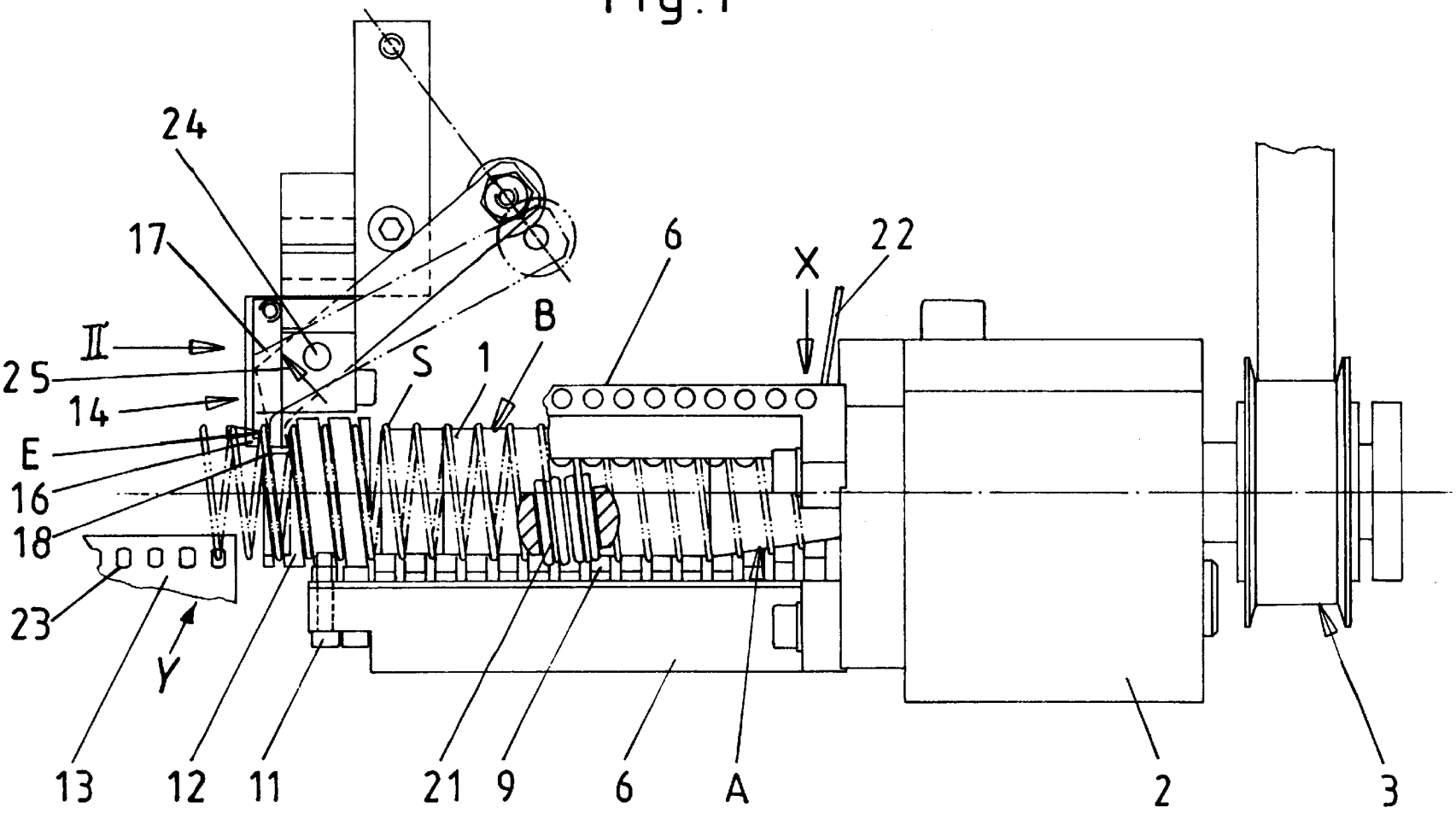
FIG. 1 is a side elevational view of an apparatus which embodies one form of the invention, a portion of a stack of overlapping perforated sheets being shown at the binding station and the foremost convolution of the foremost binder being received in the adjacent aligned perforations of the overlapping sheets.
Figure 2:
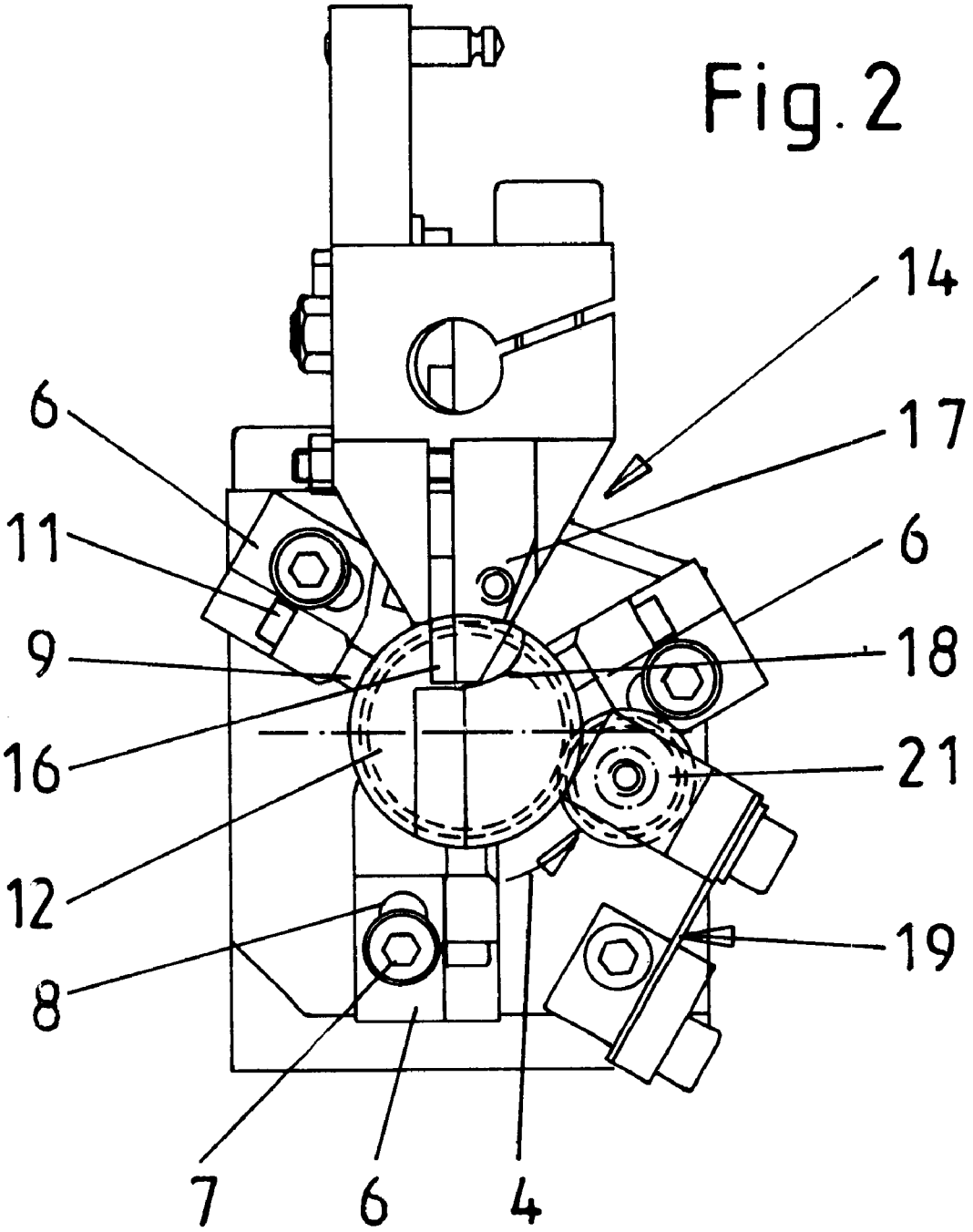
FIG. 2 is an end elevational view of the apparatus as seen in the direction of arrow II in FIG. 1.

The apparatus which is shown in FIGS. 1 and 2 comprises a composite guide including an elongated rotary convoluting tool 1 for a length of wire 22, and a stationary guide member 12 (hereinafter called worm) which is coaxial with the tool 1. The components 1 and 12 of the composite guide define an elongated straight path wherein the wire 22 is caused to advance from an inserting or introducing station X and all the way to a binding or threading station Y where successive foremost binders (i.e., coil spring-shaped sections consisting of predetermined numbers of convolutions made of wire 22) are threaded into rows of holes 23 (e.g., perforations) in selected portions or sections (e.g., spines) of accumulations 13 (such as stacks of overlapping paper sheets between pairs of cardboard covers, stacks of panels, metallic and/or plastic foils or the like, hereinafter called sheets for short).

The tool 1 is rotatably mounted in a housing 2 and can be (continuously or intermittently) rotated by a suitable drive 3 in a counterclockwise direction as seen in FIG. 2 (note the arrow 4). As can be seen in FIG. 1, the illustrated drive 3 includes a pulley on the shaft of the tool 1 and an endless flexible element (such as a belt or a chain) which can be driven by a suitable prime mover (not shown) to rotate the pulley.

That part of the rotary tool 1 which is contacted by the wire 22 includes a frustoconical portion or section A extending and diverging in a direction from the inserting station X toward the binding station Y, and a cylindrical portion or section B which extends from the maximum-diameter end of the section A all the way to the worm 12. The axial length of the section A (or at least of that part of the section A which participates in the conversion of wire 22 into a continuous tubular coil S having a series of successive helical convolutions) is or can be a fraction of the axial length of the cylindrical section B.

The tool 1 forms part of the aforementioned composite guide as well as of an arrangement which transforms the strand of wire 22 into a series of successive helical convolutions, i.e., into a series of successive binders each of which is a part of the tubular coil S and includes a predetermined number of convolutions. The transforming arrangement further comprises three sets or rows of cylindrical pins 9 which extend radially inwardly toward the axis of the tool 1. Each set of pins 9 is carried by a discrete holder or support 6 which has an elongated slot 8 for the shank of a screw, bolt or other suitable fastener 7 serving to adjustably secure the respective holder 6 to the front end of the housing 2, i.e., to that end of the housing which faces toward the binding station Y. The holders 6 and the fasteners 7 can serve as a means for adjusting the positions of the cylindrical pins 9, i.e., for converting the guide 1, 12 and the wire transforming arrangement in order to produce binders having different sizes and/or shapes.

The three holders 6 are or can be equidistant from each other as seen in the circumferential direction of the tool 1, and the slots 7 permit adjustments of these holders in the radial direction of the tool. The pins 9 are rotatably mounted in the respective holders 6 and are held by discrete locking screws 11 against movement of their radially inner ends beyond a preselected radial distance from the axis of the tool 1.

The rows of pins 9 in two of the three holders 6 are staggered relative to each other in the axial direction of the tool 1 to an extent which determines the lead of the converted (helically convoluted) wire 22, i.e., of the tubular coil S surrounding the cylindrical section B and the stationary worm 12 and advancing axially toward the binding station X. The pitch of the helical groove in the peripheral surface of the worm 12 is the same as the pitch of that portion of the tubular coil S which surrounds the section B of the tool 1 as well as the pitch of successive binders which are threaded into the rows of holes 23 in successive accumulations 13 delivered to the binding station Y in any well known manner. The same applies for the feeding of wire 22 from a suitable source (e.g., a large spool or reel, not shown) to the inserting station at the periphery of the frustoconical section A.

The front end E of the worm 12 extends all the way or practically all the way to the binding station Y, i.e., to the adjacent end of the row of holes 23 in the spine of the accumulation 13 of sheets then located at the binding station Y.

The improved apparatus further comprises means (14) for separating successive foremost binders of the tubular coil S from the neighboring (immediately following) binders as soon as the threading of the foremost binder into the row of holes 23 at the binding station Y is at least substantially completed. The illustrated separating means 14 includes a mobile knife 17 which is pivotable about the axis of a shaft 24, and a stationary knife or counterknife 16 having a free end portion or tip extending into a recess 18 (see FIG. 2) in the front end E of the worm 12. It will be seen that the severing of the foremost (inserted) binder from the next-following binder of the tubular coil S takes place in close or immediate proximity to the binding station Y.

The character 21 denotes a rotary hold-down device which is mounted on the housing 2 by way of a resilient carrier 19 (e.g., one or more leaf springs) serving to position the device 21 in dependency upon the lead of the tubular coil S. The illustrated hold-down device 21 is an idler roller having a peripheral surface provided with a helical groove for portions of convolutions forming part of the coil S; this device is adjacent the cylindrical section B of the rotary tool 1.

The operation of the improved binder forming and inserting apparatus is as follows:

The length of wire 22 is introduced into the aforementioned elongated path (surrounding the tool 1 and the worm 12) at the inserting station X. The frustoconical section A of the rotating tool 1 cooperates with the adjacent pins 9 to convert the advancing wire 22 into successive helical convolutions of the tubular coil S. The pins 9 cooperate with the frustoconical section A to effect at least some stretching of the advancing wire 22 and thus stabilize the freshly formed convolutions of the coil S. As already mentioned above, the pins 9 are rotatable in (i.e., relative to) their respective holders 6.

The purpose of the cylindrical section B of the tool 1 is to establish a desirable force-locking connection between the convolutions of the coil S and the rotating tool, and such force-locking connection is not only ensured but actually enhanced by the resiliently mounted hold-down device 21.

The stationary worm 12 accepts and guides successive convolutions of the coil S on their way from the discharge end of the cylindrical section B toward the binding station Y so that the mutual positions of successive convolutions surrounding and advancing along the helically grooved or ribbed peripheral surface of the worm 12 remain unchanged.

As the convolutions of the coil S continue to advance axially and away from the tool 1 and beyond the front end E of the worm 12, they are automatically threaded into the row of holes 23 in the accumulation 13 of sheets then located at the binding station Y.

Once a predetermined length of the coil S (i.e., a complete binder) has advanced beyond the front end E of the worm 12 (such length depends upon the dimensions of the accumulation 13 at the station Y), namely when the conversion of sheets at the station Y into a stationery product is completed, the drive 3 for the tool 1 is brought to a halt and the separating means 14 is actuated to sever the wire 22 in the recess 18 of the front end E of the worm 12 in such a way that the binder of the stationery product at the station Y includes a relatively small projection or stub extending beyond the rearmost set of aligned holes 23, i.e., beyond the set of holes 23 nearest to the recess 18. The separating operation or step involves severing of that convolution of the arrested coil S which then extends into the recess 18, and such step is carried out by the mobile knife 17 in cooperation with that portion of the stationary knife 16 which extends into the recess 18. The direction in which the knife 17 is to be pivoted about the axis of its shaft 24 to sever the wire of the coil S is indicated by the arrow 25.

An advantage of severing the wire 22 in the recess 18 at the front end E of the stationary worm 12 is that the leader or tip at the forward end of the binder immediately following the freshly separated binder (i.e., the foremost helix of those helices which are guided by the stationary worm 12) is highly unlikely to be deformed in the course of the severing or separating operation so that such leader can reliably find its way into the nearest set of aligned holes 23 in the next-following accumulation 13 delivered to the binding station Y not later than when the drive 3 is started again to rotate the tool 1. Thus, the improved apparatus reduces the likelihood of misorientation of the leaders of successive binders relative to the holes 23 of accumulations 13 of sheets at the station Y on several grounds, namely because the wire 22 is guided all the way from the wire supplying or inserting station X to the bonding station Y, and because the separation of successive foremost binders from the reminder of the tubular coil S does not entail any undesirable deformation and/or displacement of the thus formed leader at the front end of the next binder which is about to enter the station Y.

Another important advantage of the improved apparatus is that it can highly reliably guide the convoluted wire 22 at that location (E) where such guidance is most likely to prevent undesirable deformation and/or improper orientation of the leader of the wire on the way into the holes 23 of the next accumulation of sheets at the station Y.

As used herein, the terms "tubular coil" and "binder" are respectively intended to denote longer and shorter series of coherent helical convolutions having a predetermined lead and a predetermined pitch best suited for convenient and predictable introduction or threading into rows of holes 23 at the binding station Y. Such coils and binders are also called wire helices and wire screws.

Without further analysis, the foregoing will so fully reveal the gist of the present invention that others can, by applying current knowledge, readily adapt it for various applications without omitting features that, from the standpoint of prior art, fairly constitute generic and specific aspects of the above outlined contribution to the art of making and inserting helical wire binders and, therefore. such adaptations should and are intended to be comprehended within the meaning and range of equivalence of the appended claims.

What is claimed is:

1. Apparatus for converting a length of wire into a series of helical wire binders and for inserting successive binders of the series into rows of holes in portions of discrete accumulations of overlapping sheets at a binding station, the binders of said series including a succession of foremost binders and binders following said foremost binders, comprising guide means defining an at least substantially continuous path for the wire from a wire inserting station to said binding station, said guide means comprising a wire convoluting tool remote from said binding station and a stationary guide member disposed between said tool and said binding station, having a front end portion at said binding station and being surrounded by convoluted wire; and means for transforming the convoluted wire in said path into said series of successive binders, including means for separating successive foremost binders from the respective following binders upon arrival of successive foremost binders at said binding station, said separating means comprising at least one first knife recessed into said front end portion of said guide member at least in the course of separation of a foremost binder from the respective following binder and a mobile second knife cooperating with said at least one first knife.

2. The apparatus of claim 1, wherein said path is an at least substantially straight path.

3. The apparatus of claim 1, wherein said tool is a rotary wire convoluting tool and said stationary guide member comprises a worm at least substantially coaxial with said tool.

4. The apparatus of claim 1 for converting wire into binders having a predetermined lead, wherein said tool is a rotary wire convoluting tool and further comprising a rotary hold-down device for the wire in said path, said device being adjacent said tool and further comprising means for positioning said device relative to said tool as a function of said lead.

5. The apparatus of claim 4, wherein said hold-down device comprises a roller having a peripheral surface provided with a helical wire-receiving groove.

6. The apparatus of claim 4, wherein said positioning means includes a resilient carrier for said hold-down device.

7. The apparatus of claim 6, wherein said resilient carrier comprises at least one leaf spring.

8. The apparatus of claim 1, wherein said tool is a rotary wire convoluting tool having a substantially conical section-adjacent said inserting station and diverging toward said binding station.

9. The apparatus of claim 8, wherein said tool further comprises a substantially cylindrical section between said conical section and said binding station.

10. The apparatus of claim 1, further comprising means for adjusting said guide means for the conversion of wire into binders having at least one of (a) different sizes and (b) different shapes.

11. Apparatus for converting a length of wire into a series of helical wire binders having a predetermined lead and for inserting successive binders of the series into rows of holes in portions of discrete accumulations of overlapping sheets at a binding station, comprising guide means defining an at least substantially continuous path for the wire from a wire inserting station to said binding station, said guide means comprising a rotary wire convoluting tool; means for transforming the wire in said path into said series of successive binders; a rotary hold-down device for the wire in said path, said device being adjacent said tool; and means for positioning said device relative to said tool as a function of said lead, including a resilient carrier for said hold-down device.

12. The apparatus of claim 11, wherein said resilient carrier comprises at least one leaf spring.

13. Apparatus for converting a length of wire into a series of helical wire binders and for inserting successive binders of the series into rows of holes in portions of discrete accumulations of overlapping sheets at a binding station, comprising adjustable guide means defining an at least substantially continuous path for the wire from a wire inserting station to said binding station; means for transforming the wire in said path into a series of successive binders; and means for adjusting said guide means for the conversion of wire into binders having at least one of (a) different sizes and (b) different shapes.

* * * * *